US007325990B2

(12) United States Patent
Svendsen et al.

(10) Patent No.: US 7,325,990 B2
(45) Date of Patent: Feb. 5, 2008

(54) METHOD OF DECK STAIN APPLICATOR

(75) Inventors: John M. Svendsen, Corcoran, MN (US); Wayne Robens, Lakeville, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 0 days.

(21) Appl. No.: 11/673,700

(22) Filed: Feb. 12, 2007

(65) Prior Publication Data

US 2007/0147943 A1 Jun. 28, 2007

Related U.S. Application Data

(62) Division of application No. 10/808,257, filed on Mar. 24, 2004, now Pat. No. 7,192,210.

(51) Int. Cl.

| | |
|---|---|
| ***A46B 15/00*** | (2006.01) |
| ***A46B 11/00*** | (2006.01) |
| ***A47L 13/12*** | (2006.01) |
| ***B05D 1/28*** | (2006.01) |

(52) U.S. Cl. ..... 401/9; 401/140; 15/114; 15/115; 427/429

(58) Field of Classification Search ..... 401/9, 401/10, 137–140; 15/114, 115, 116.1, 116.2, 15/160, DIG. 5; 427/429, 140

See application file for complete search history.

(56) References Cited

U.S. PATENT DOCUMENTS

| | | | |
|---|---|---|---|
| 1,437,177 | A | 11/1922 | Hartman |
| 2,785,426 | A | 3/1957 | Grey |
| 4,517,702 | A | 5/1985 | Jackson |
| 4,611,941 | A | 9/1986 | Karliner et al. |
| 4,695,176 | A | 9/1987 | Simonette et al. |
| 4,732,503 | A | 3/1988 | Bader et al. |
| 4,810,123 | A | 3/1989 | Bruggeman |
| 4,822,194 | A | 4/1989 | Simonette |
| 4,845,799 | A | 7/1989 | Amundson |
| 4,997,302 | A | 3/1991 | Simonette |
| 5,522,110 | A | 6/1996 | Borofsky |
| D417,552 | S | 12/1999 | Snetting et al. |
| 6,142,693 | A | 11/2000 | Bruggeman et al. |
| 6,244,771 | B1 | 6/2001 | Bruggeman et al. |
| D444,928 | S | 7/2001 | Bruggeman et al. |

OTHER PUBLICATIONS

Quick-start Wagner Stain Mate, Owner's manual, 16 pp.
Quick-start Wagner Paint Mate, Owner's manual, 16 pp.

*Primary Examiner*—David J. Walczak
(74) *Attorney, Agent, or Firm*—Faegre & Benson LLP

(57) ABSTRACT

A method for use of a deck stain applicator having a generally flat coating applicator pad having at least one coating delivery channel therethrough for delivery of coating material at a planar application surface of the pad for coating a generally planar surface having at least one gap therein and a plurality of bristles extending out of the planar surface of the pad for applying the coating material to a pair of opposed surfaces to be coated forming the gap and at least one recess in the pad for receiving the plurality of bristles when the pad is moved across the planar surface and the bristles are not aligned with the gap.

5 Claims, 21 Drawing Sheets

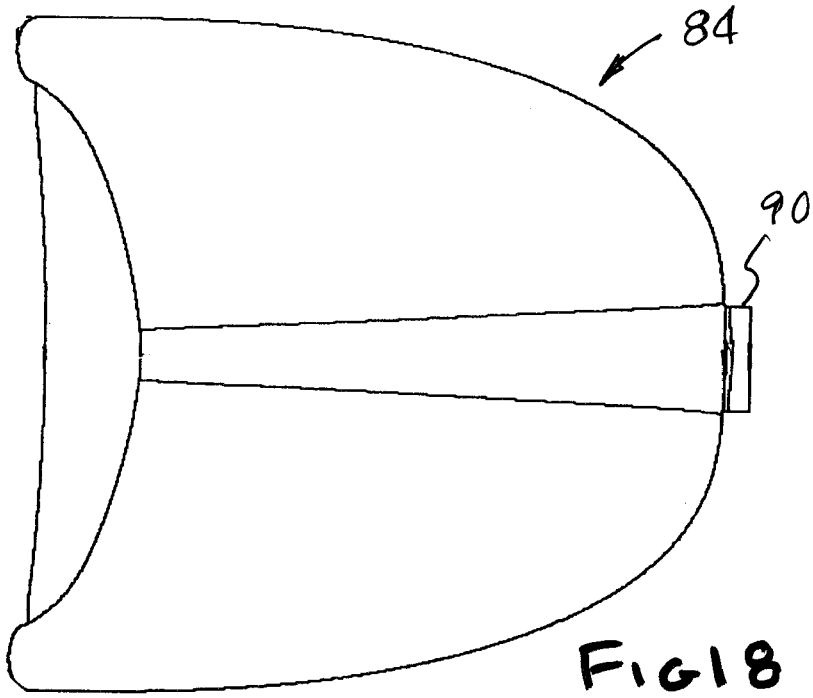
FIG 18
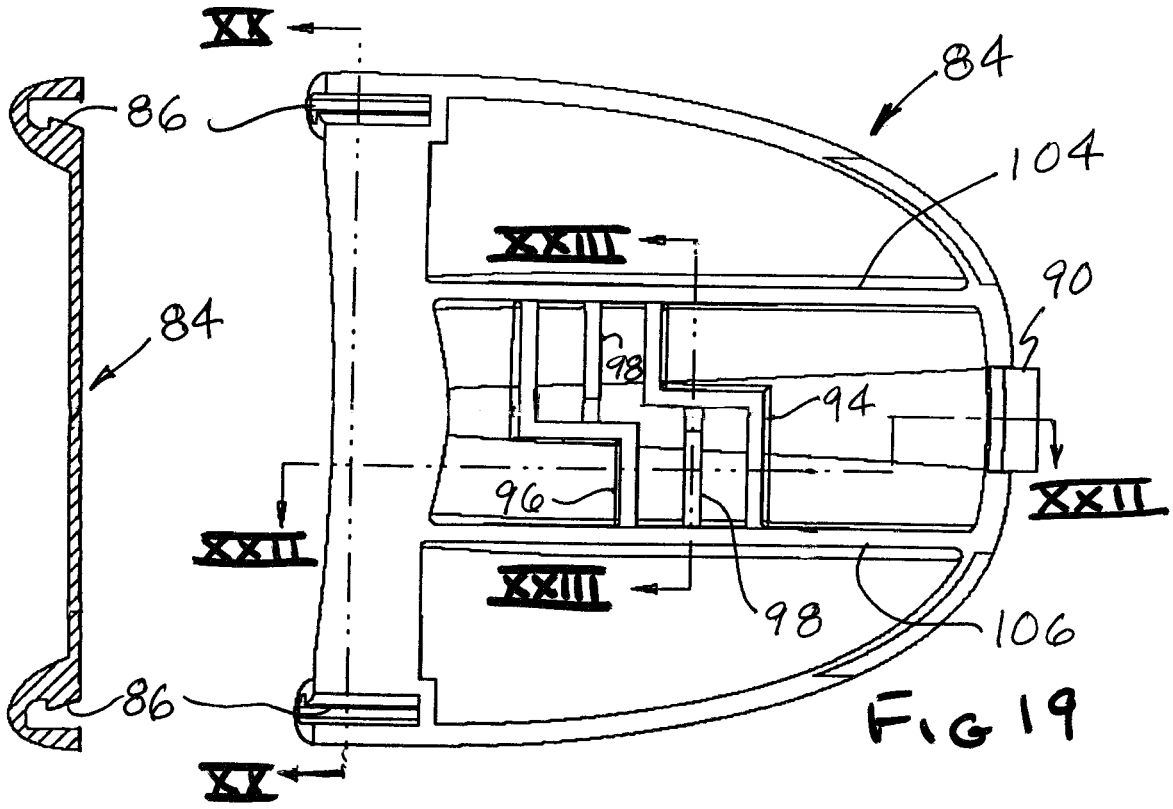
FIG 19
FIG 20

METHOD OF DECK STAIN APPLICATOR

CROSS REFERENCE TO RELATED APPLICATION

This application is a division of application Ser. No. 10/808,257 filed Mar. 24, 2004, now U.S. Pat. No. 7,192,210 the entire contents of which are hereby incorporated by reference.

BACKGROUND OF THE INVENTION

The present invention is in the field of coating applicators, particularly for applying coating such as stain to surfaces such as decks, characterized by a generally planar surface with intentional gaps between elements, typically boards, of the deck. In the past, it has been difficult to apply stain to the opposed surfaces of the boards in the gaps of decks since pad type applicators have been preferred to apply the stain to the deck. Alternatively or in addition to the pad type applicator, a conventional brush has been known to be used to apply stain both to the planar surface and to the opposed surfaces in the gaps. Using a brush, however, has been found to be time consuming and awkward, necessitating stooping to reach the deck elements with the brush.

BRIEF SUMMARY OF THE INVENTION

The present invention retains the benefits of a generally planar pad applicator for applying coatings such as stain to gapped planar surfaces such as are conventional in decks. The applicator of the present invention additionally includes at least one and preferably two bundles or groups of bristles extending out of the plane of the pad applicator for applying stain to the opposed surfaces in the gap at the same time stain is applied to the planar surface of the deck. The present invention includes a method of applying coating material to a generally planar deck or deck-like surface of the type having members having opposed surfaces separated by gaps, by applying the coating material to the generally planar surface by delivering the coating material to a generally flat coating applicator pad through at least one delivery channel adjacent the applicator pad; and simultaneously applying the coating material to opposed surfaces of the members in the gap by delivering the coating material to the opposed surfaces using a plurality of bristles extending out of the planar surface.

BRIEF DESCRIPTION OF THE DRAWINGS

FIG. 18 is a top plan view of the cover of FIG. 17.

FIG. 19 is a bottom plan view of the cover of FIG. 17.

FIG. 20 is a section view taken along line XX-XX of FIG. 19.

DETAILED DESCRIPTION OF THE INVENTION

Figure 1:
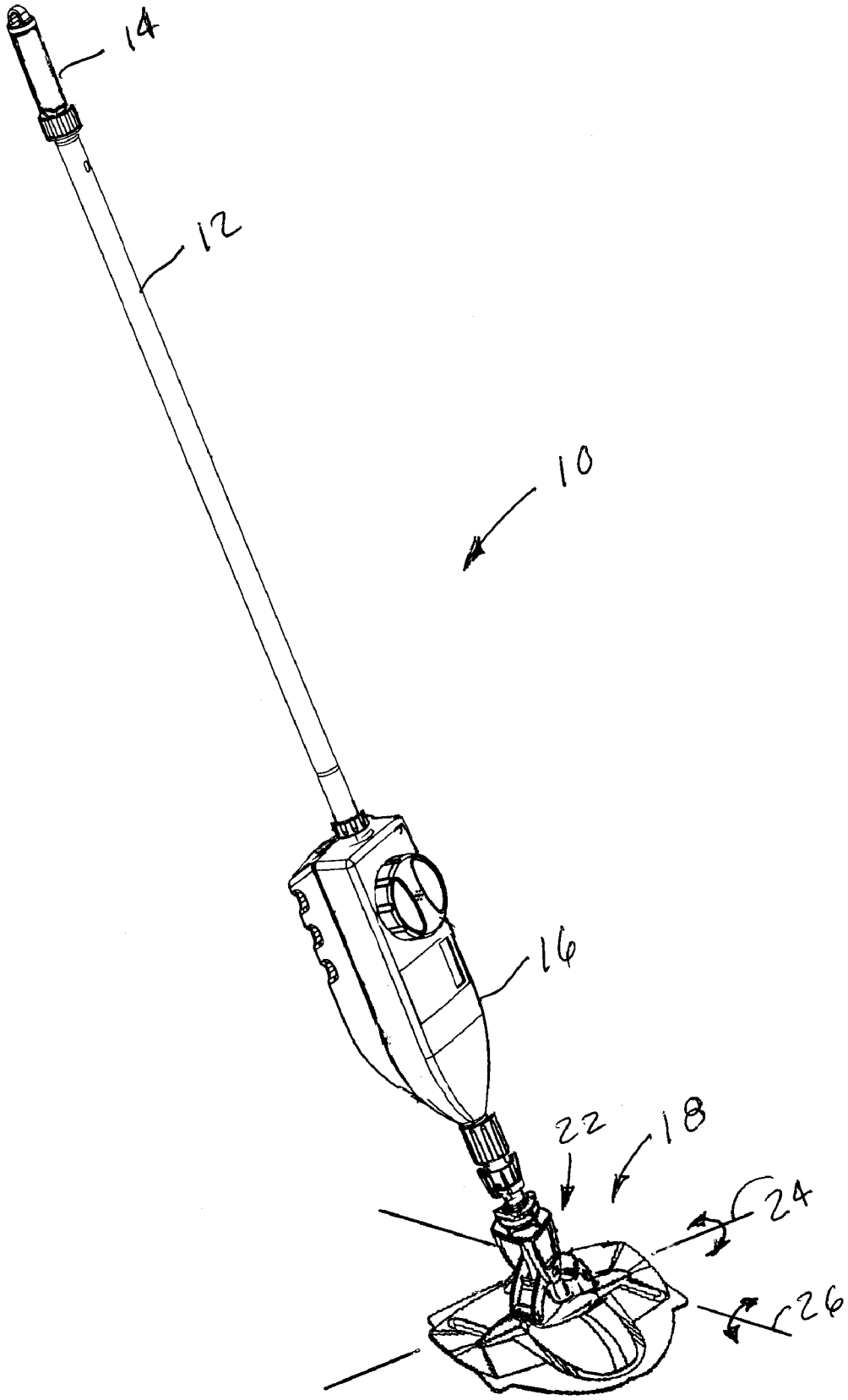
FIG. 1 is a perspective view of a deck stain applicator of the present invention.

Referring now to the Figures, and most particularly to FIG. 1, a deck stain applicator 10 may be seen. By "stain" as it is used herein, is meant conventional liquid wood stains and preservatives, with or without pigment or tint, and similar liquid coating materials, whether for wood or wood-like materials. Both penetrating and non-penetrating coating materials are to be understood to be within the meaning of "stain" as used herein. Stains are typically less viscous and less opaque than paint.

The applicator 10 has a handle 12 and a hand grip 14 at a proximal end thereof. Handle 12 may extend through a liquid reservoir 16 and support an applicator head assembly 18 at a distal end of the handle 12. Assembly 18 has a pad type applicator, which may have a exposed nap layer or napped pad (not shown in FIG. 1) for applying the stain to a generally planar surface.

Figure 10:
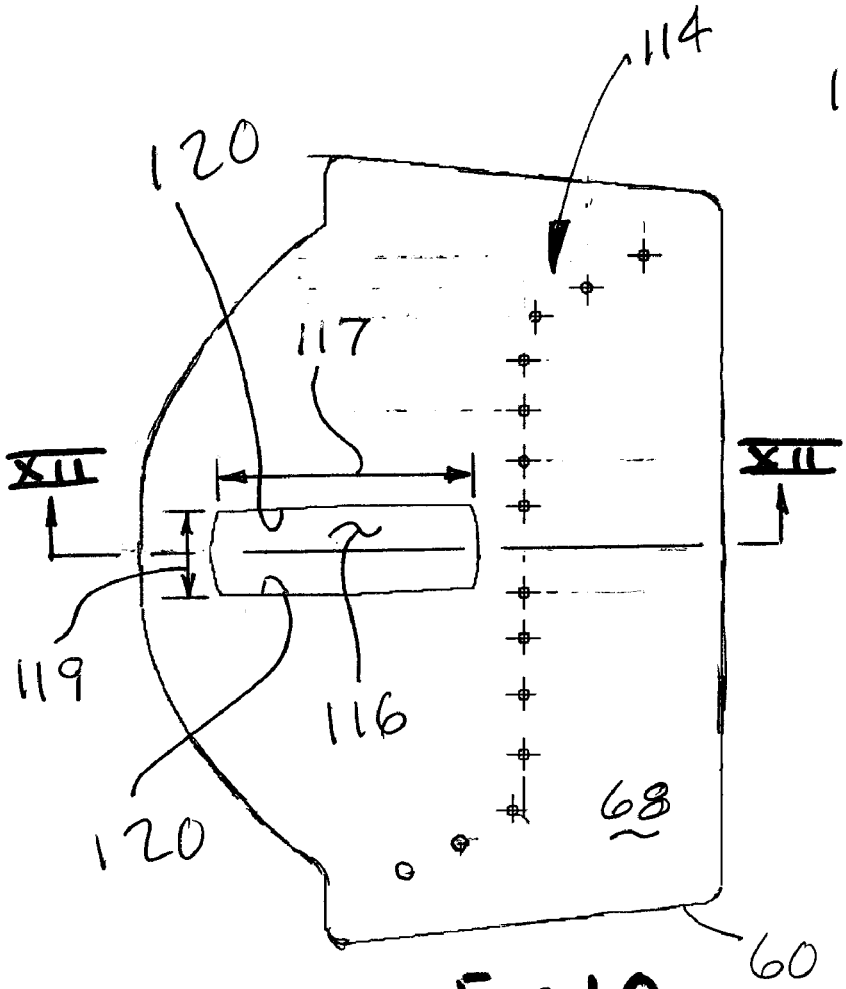
FIG. 10 is a plan view of a napped pad useful in the practice of the present invention.
Figure 11:
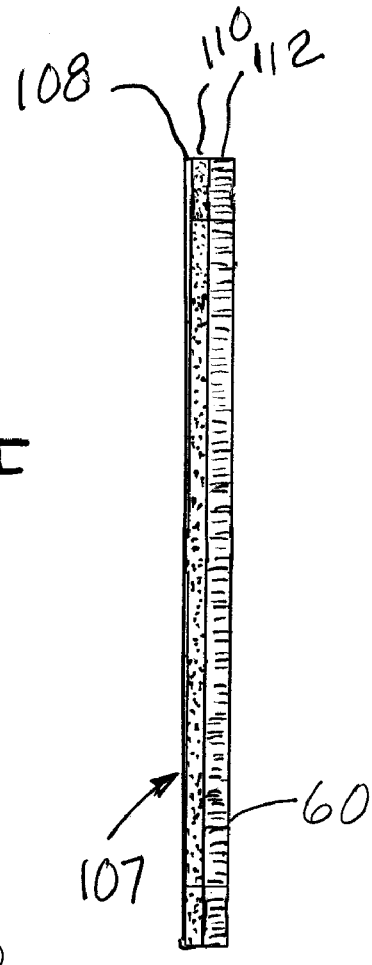
FIG. 11 is an elevation view of the napped pad of FIG. 10.
Figure 12:
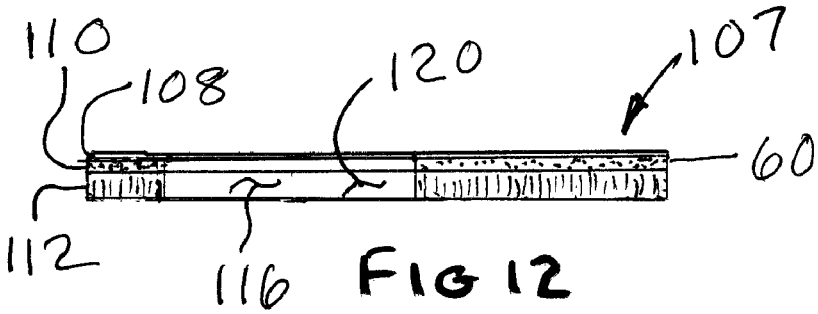
FIG. 12 is a section view taken along line XII-XII of FIG. 10.

Referring now also to FIGS. 2-5, various features of the applicator head assembly 18 may be seen. The applicator head assembly 18 has a baseplate 20, also shown in FIGS. 9 and 15. It is to be understood that the nap layer is omitted from the applicator head assembly 18 in the views shown in FIGS. 2, 4, 5 and 9 to more clearly illustrate certain features of the present invention; however the napped pad illustrated in FIGS. 10, 11 and 12 is part of the applicator head assembly 18. The applicator head assembly has a swivel connection 22 allowing the applicator head assembly 18 to pivot to a limited extent around axes 24 and 26, as perhaps may be seen most clearly in FIG. 14. A flexible tube 28 provides a fluid passageway from the liquid reservoir 16 to the applicator head assembly 18, while permitting the pivoting movement. Referring now also to FIGS. 9, 26, 27 and 28, tube 28 is received on barbed fitting 30 to deliver liquid coating material from the reservoir 16 to the opening 32 in face 34 of the baseplate 20 of the applicator head assembly 18. Opening 32 is in fluid communication with a main channel 36 in face 34. Main channel 36 has a pair of diagonally oriented extensions 38. Main channel 36 is also in fluid communication with a pair of bristle fluid delivery channels 40 and 42. Baseplate 20 also has a recess 44 in the form of an aperture through the baseplate 20 which preferably has two relatively longer, generally straight sides and two relatively shorter sides which may be curved and oriented as shown, but it is to be understood that the aperture may alternatively be a rectangle or parallelepiped or another shape having sufficient clearance for the purpose of allowing the bristles to deflect as described in more detail below.

Figure 16:
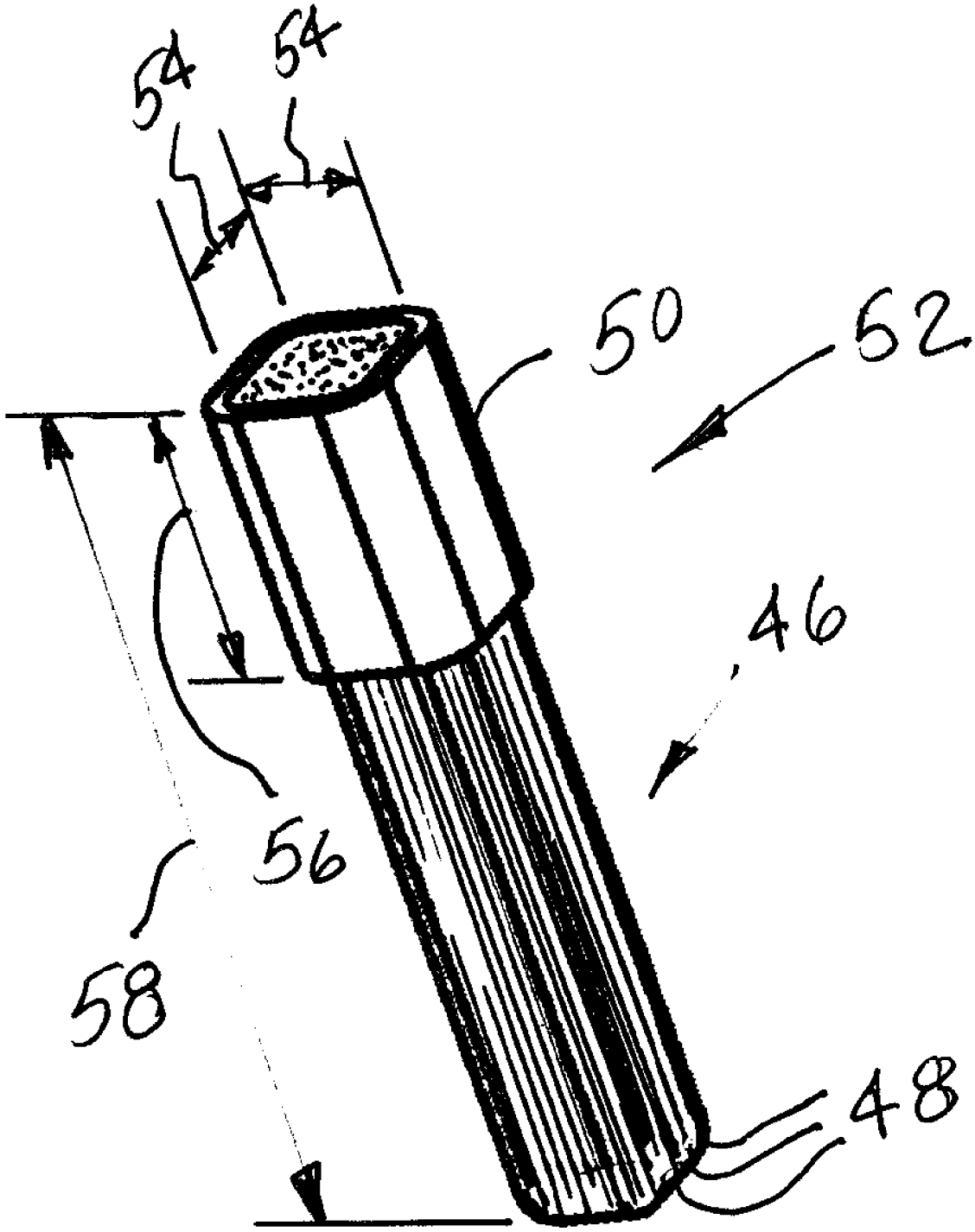
FIG. 16 is a perspective view of a group of bristles mounted in a ferrule useful in the practice of the present invention.
Figure 17:
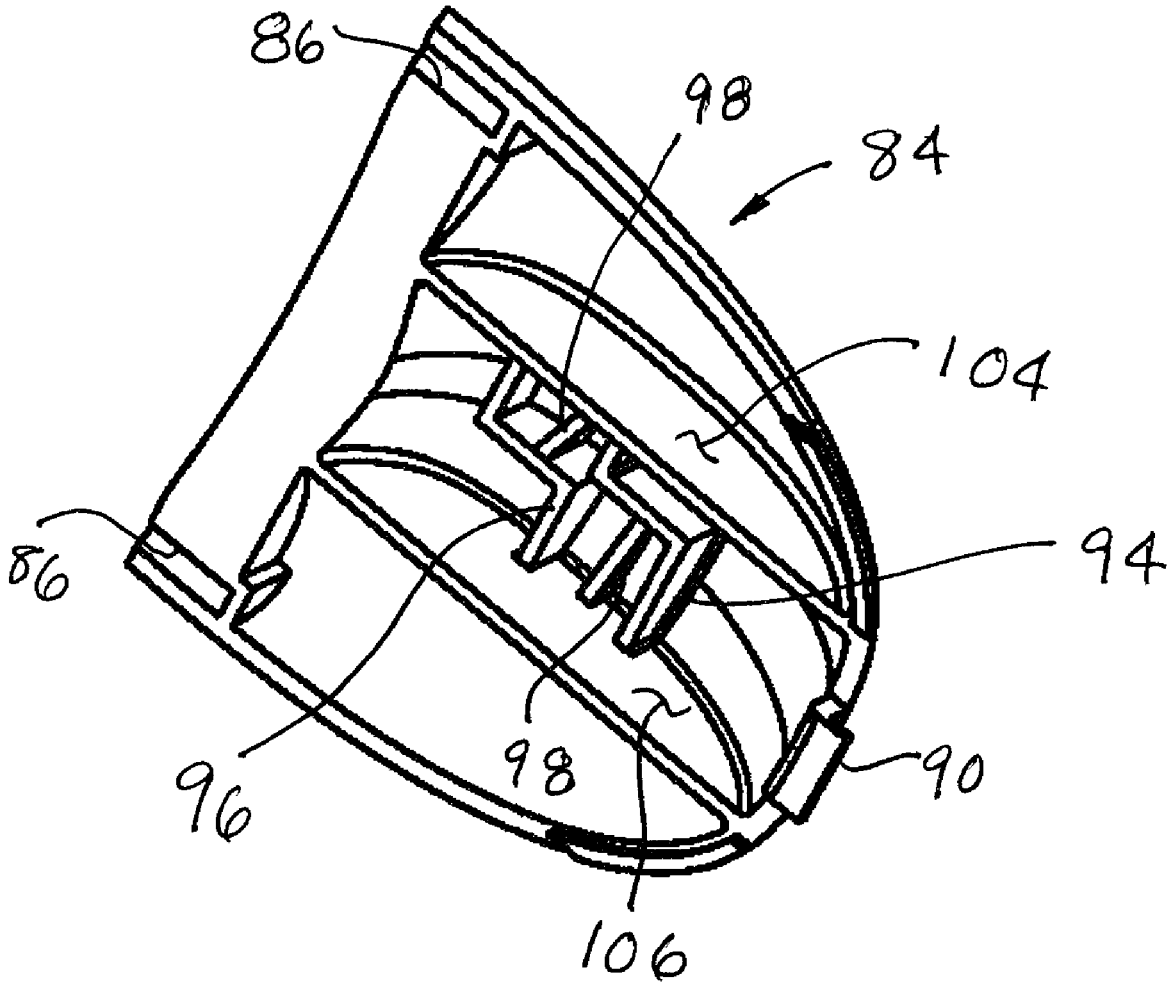
FIG. 17 is a perspective view from below of a cover for the applicator head assembly of the present invention.
Figure 21:
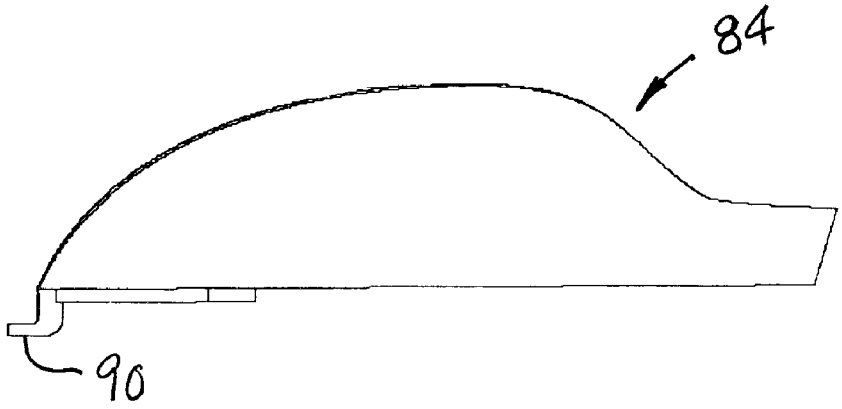
FIG. 21 is a side elevation view of the cover of FIG. 17.
Figure 22:
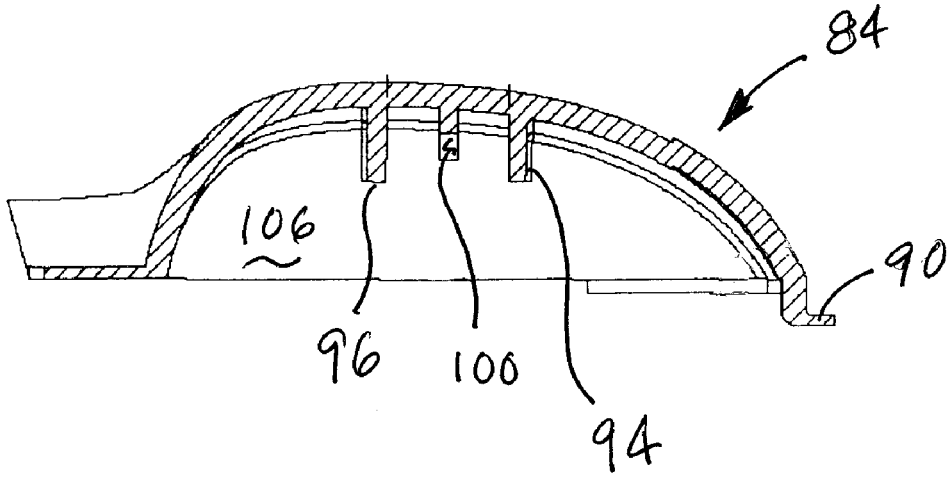
FIG. 22 is a section view taken along line XXII-XXII of FIG. 19.
Figure 23:
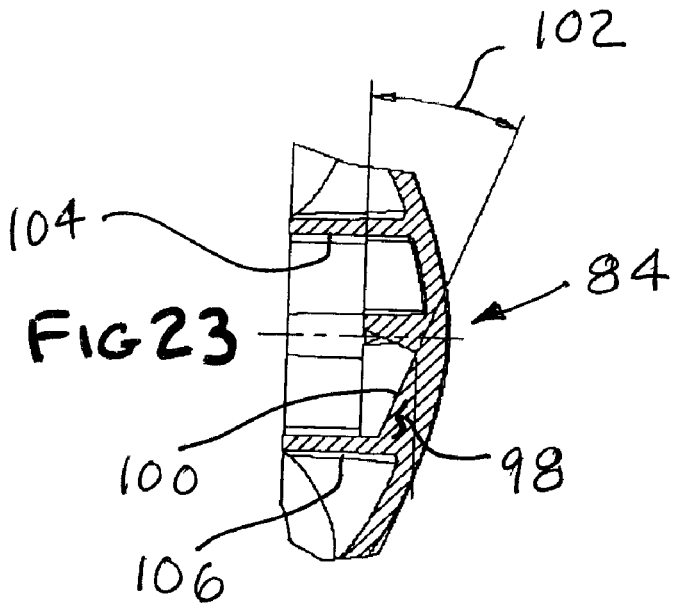
FIG. 23 is a section view taken along line XXIII-XXIII of FIG. 19.
Figure 24:
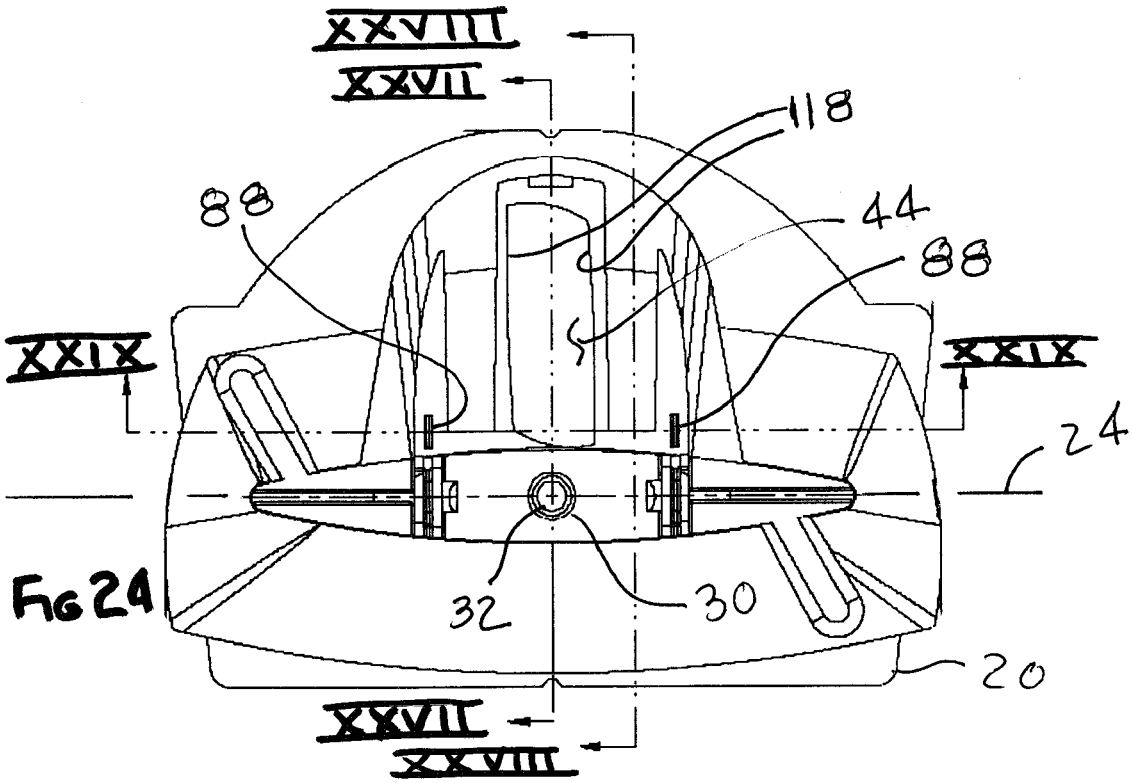
FIG. 24 is a top plan view of the baseplate of FIG. 15.
Figure 25:
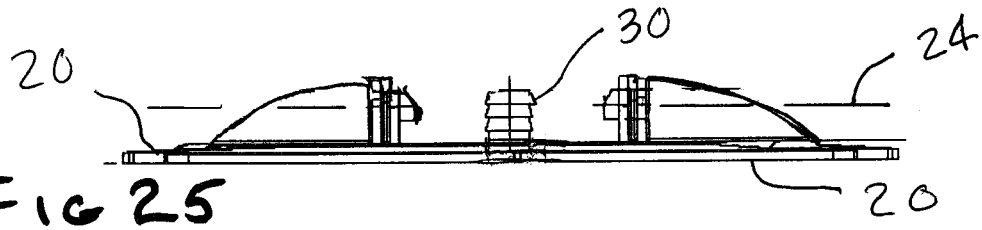
FIG. 25 is a rear elevation view of the baseplate of FIG. 15.

Referring now most particularly to FIGS. 2, 4, 5, 9 and 16, the present invention includes one and preferably two bristle groups 46, as shown in FIG. 16. The bristle group 46 includes a plurality of bristles 48 secured into the group or bundle or assembly 52 by a ferrule 50. Bristles 48 may be natural bristles such as are used in better paint brushes, but preferably are lower cost filaments made of flexible synthetic polymer material, such as a polyamide, for example nylon 6 or another grade or type of nylon or other similar material. Each bundle of filaments is secured in ferrule 50 by epoxy or another conventional means of securing the bristles together in a group. Ferrule 50 has an opening with side dimensions 54 of about 0.295 inches by about 0.295 inches and has a length 56 about 0.55 inches long. An overall length 58 of the bristle assembly 52 is about 1.75 inches. The ferrule wall thickness may be 0.040 inches. Other dimensions and cross sectional shapes for the ferrule and overall length may be used while still remaining within the scope of the present invention.

Figure 13:
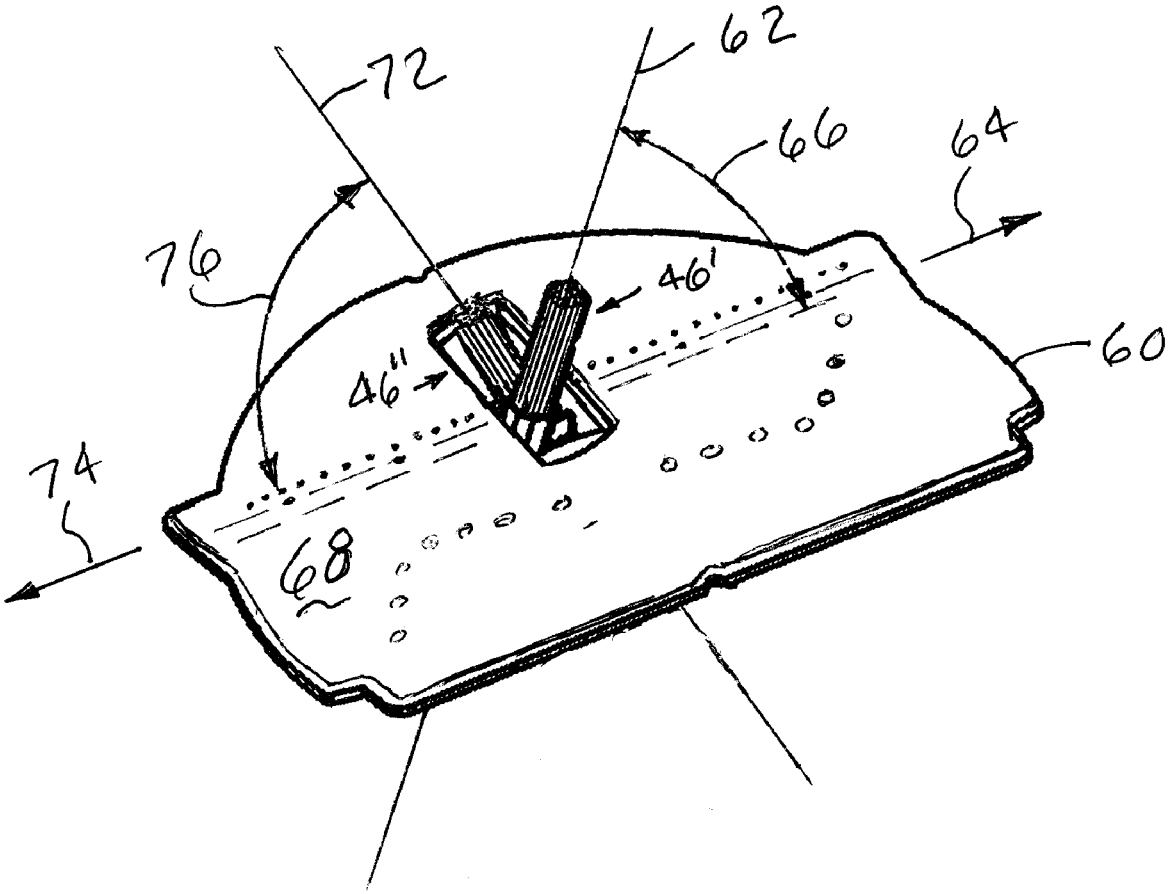
FIG. 13 is a perspective view similar to FIG. 9, except including the napped pad and with other parts of the applicator head assembly omitted for clarity in illustrating certain aspects of the present invention.

As shown in FIG. 13 where a pad 60 is shown attached to the baseplate 20, bristle assemblies 52 preferably extend out from a generally flat coating applicator pad 60 having at least one coating delivery channel therethrough for delivery of coating material at a planar application surface of the pad. The plurality of bristles 48 extend out of the planar surface of the pad 60 for applying the coating material to opposed surfaces to be coated that are typically perpendicular to a generally planar surface to be coated by pad 60. By having two bristle groups extending at an angle as shown, each of the opposed surfaces forming the gap may be coated simultaneously with coating the planar surface with the pad 60.

Figure 2:
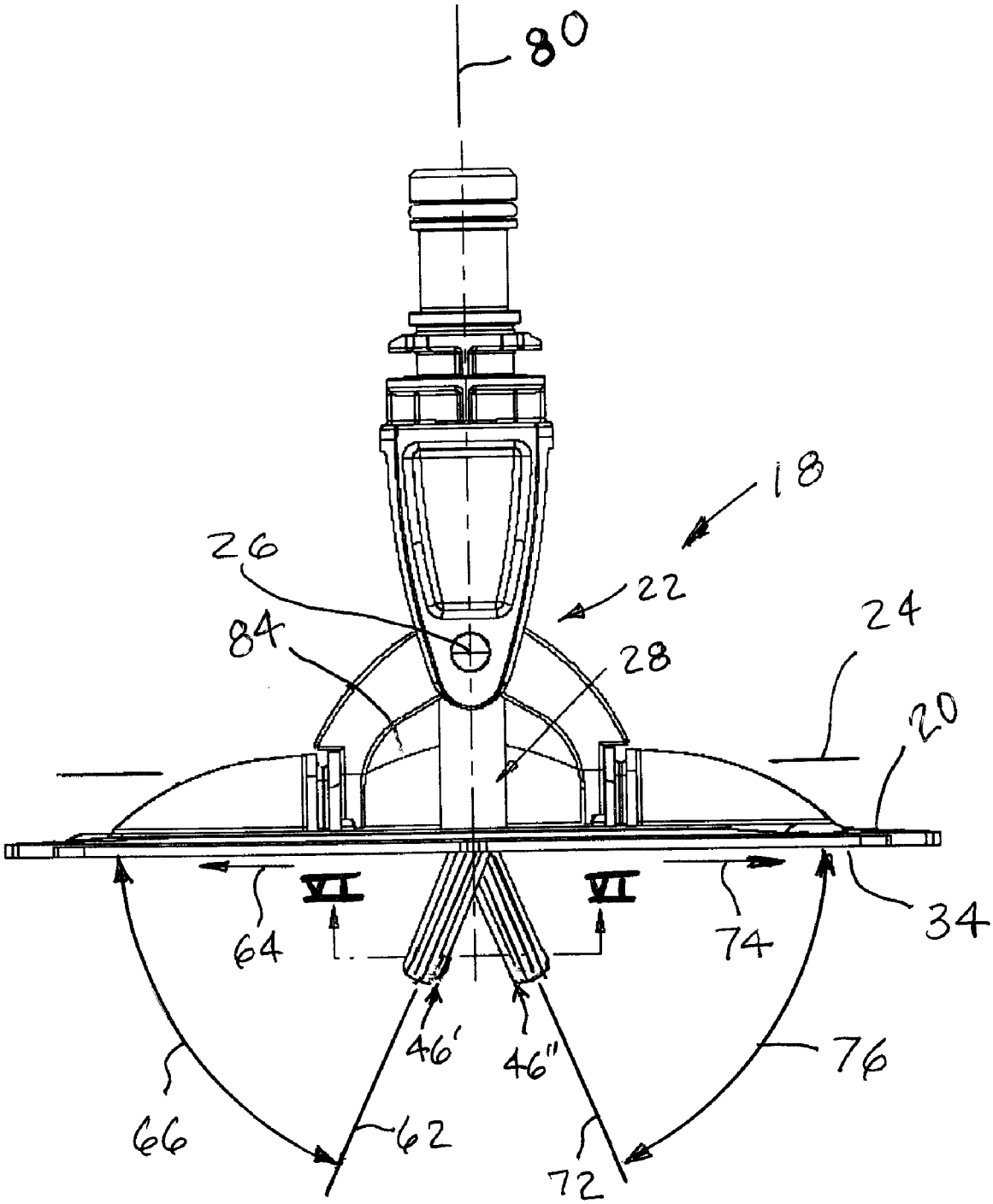
FIG. 2 is an enlarged front elevation view of an applicator head assembly with a napped pad omitted.
Figure 3:
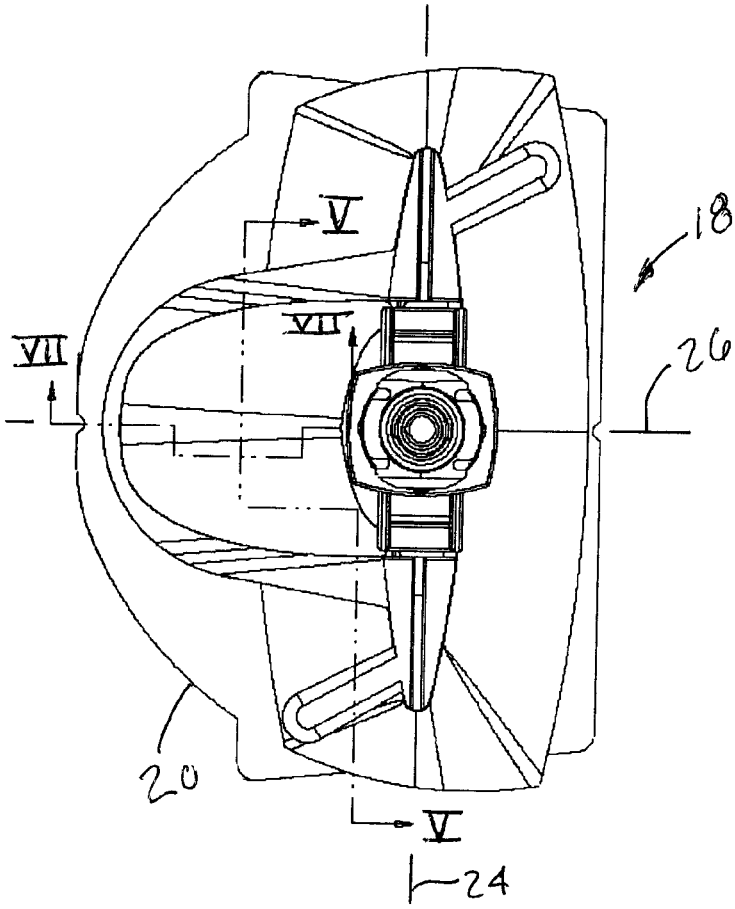
FIG. 3 is a top view of the applicator head assembly of FIG. 2.
Figure 4:
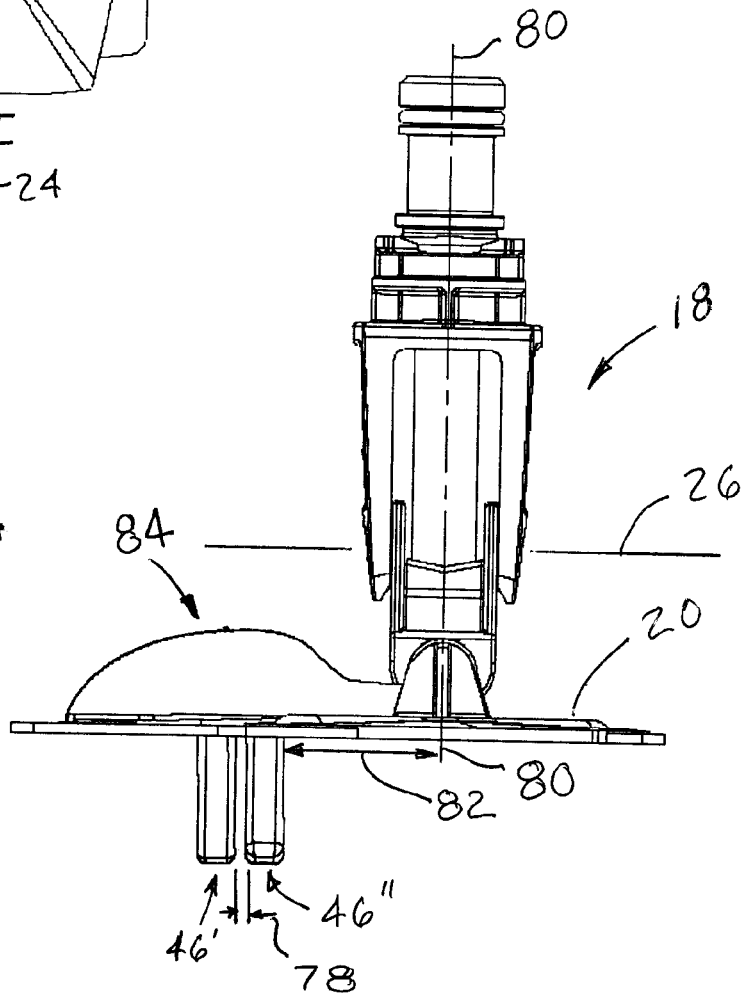
FIG. 4 is a side elevation view of the applicator head assembly of FIG. 2.
Figure 5:
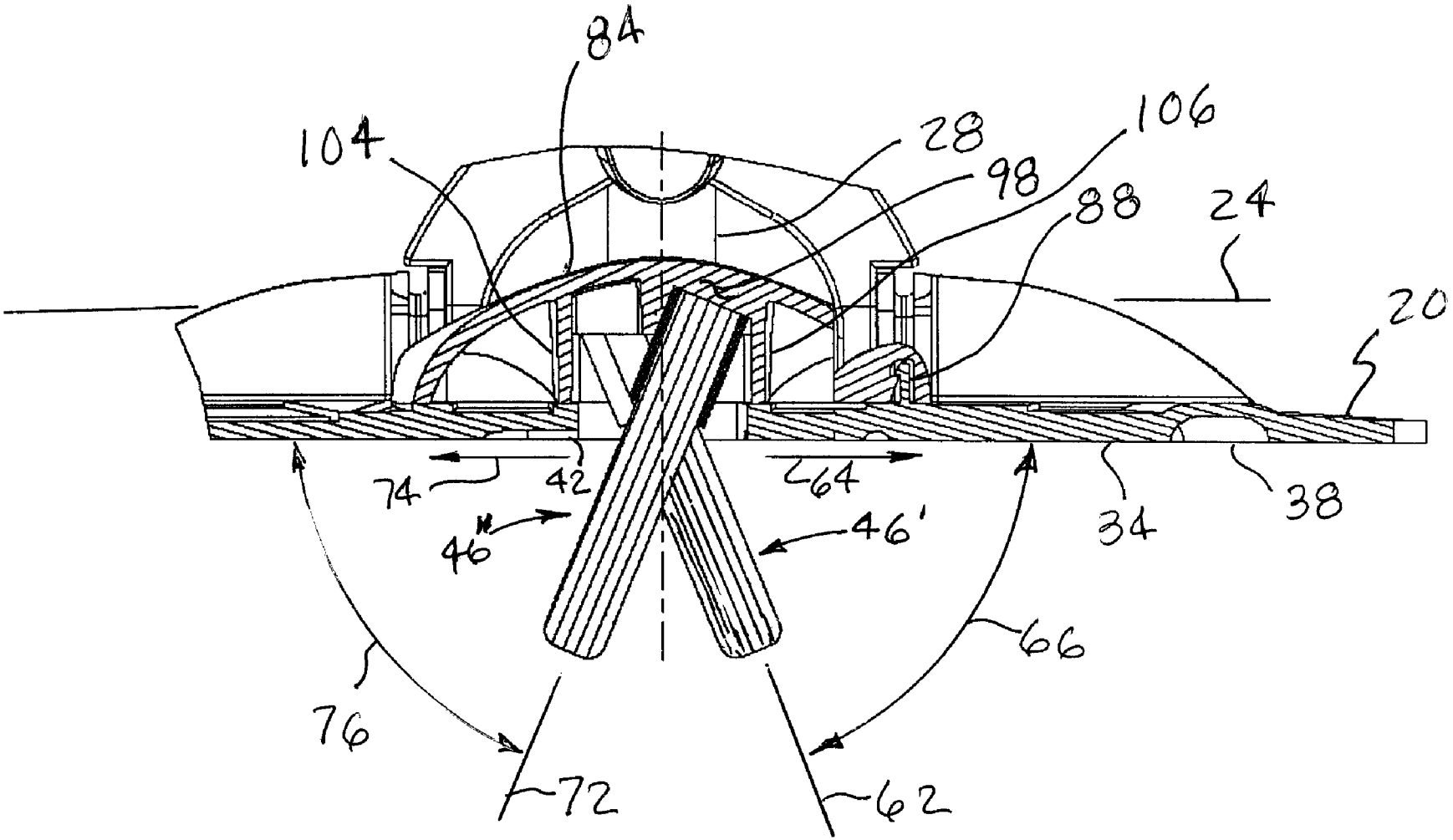
FIG. 5 is a fragmentary section view of a portion of the applicator head assembly taken along line V-V of FIG. 3 and showing certain internal details thereof, but with the napped pad omitted.
Figure 6:
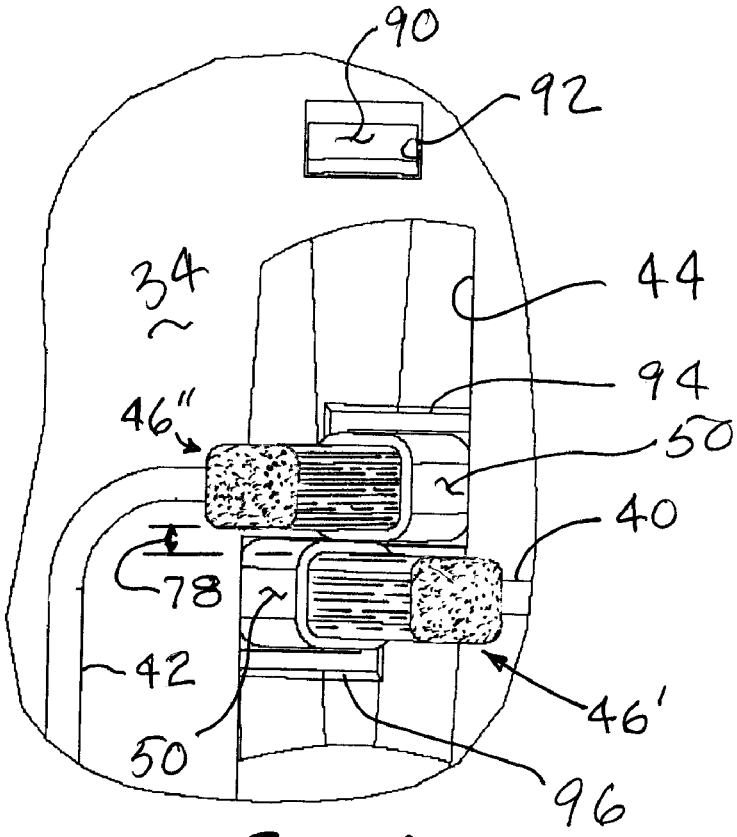
FIG. 6 is fragmentary section view taken along line VI-VI of FIG. 2.

As may be seen in FIGS. 2, 5, and 13 the plurality of bristles 48 includes a first group 46' of bristles oriented along a first axis 62 in a first direction 64 and at a first angle 66 of less than 90° to the planar surface 68 of the pad 60. Furthermore, the plurality of bristles preferably includes a second group 46" of bristles oriented along a second axis 72 in a second direction 74 and at a second angle 76 to the planar surface 68 of the pad 60, wherein the second angle 76 is generally equal to the first angle 66 and wherein the second direction 74 is generally opposite to the first direction 64. Preferably, each of angles 66 and 76 are about 67.5 degrees, but it is to be understood that other angles between 0 and 90 degrees may be used, and further that angles 66 and 76 do not necessarily need to be equal to each other in the practice of the present invention. As may be seen most clearly in FIGS. 4, 6 and 7, the first group 46' of bristles is preferably offset by a distance 78 of twice the wall thickness of the ferrule or about 0.08 inches from the second group 46" of bristles, although other offset distances may be used in the practice of the present invention. The first and second groups 46' and 46" of bristles are preferably offset from an axis 80 of the handle by a distance 82 of about 1.25 inches, although another dimension may be used for distance 82 while still remaining within the scope of the present invention.

Figure 7:
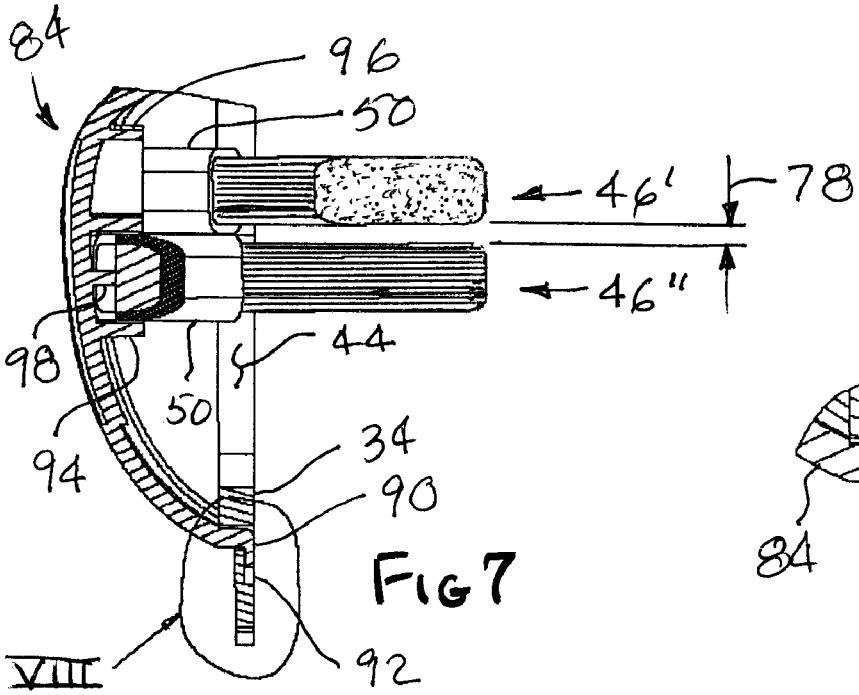
FIG. 7 is an enlarged fragmentary section view taken along line VII-VII of FIG. 3.
Figure 8:
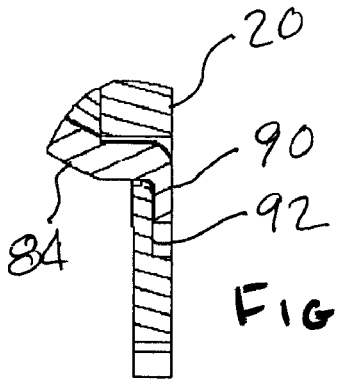
FIG. 8 is an enlarged view of detail VIII from FIG. 7.
Figure 9:
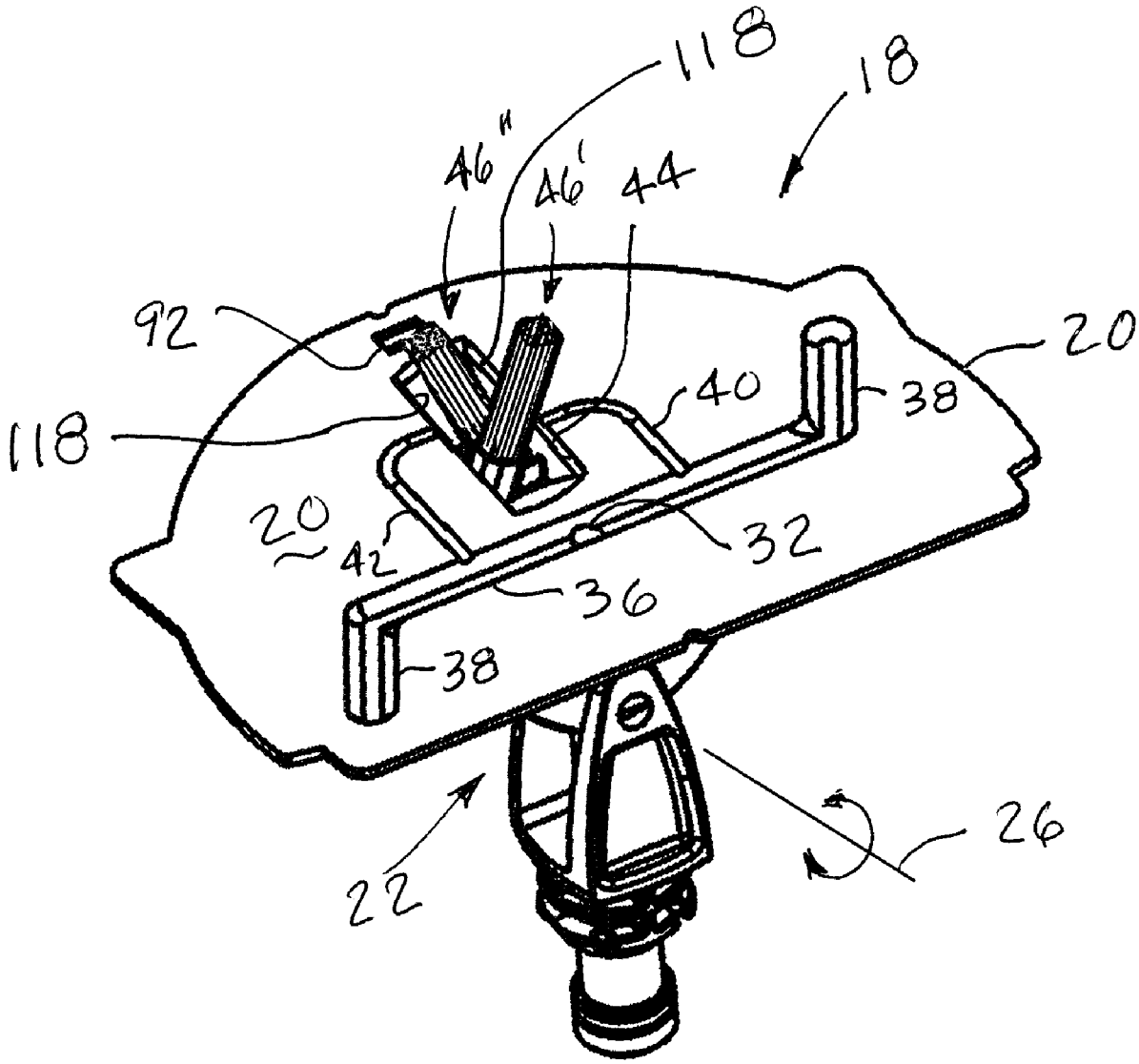
FIG. 9 is a perspective view of the applicator head assembly of FIG. 2 with the assembly inverted and with a napped pad omitted to show certain details of a baseplate for the applicator head assembly.
Figure 29:
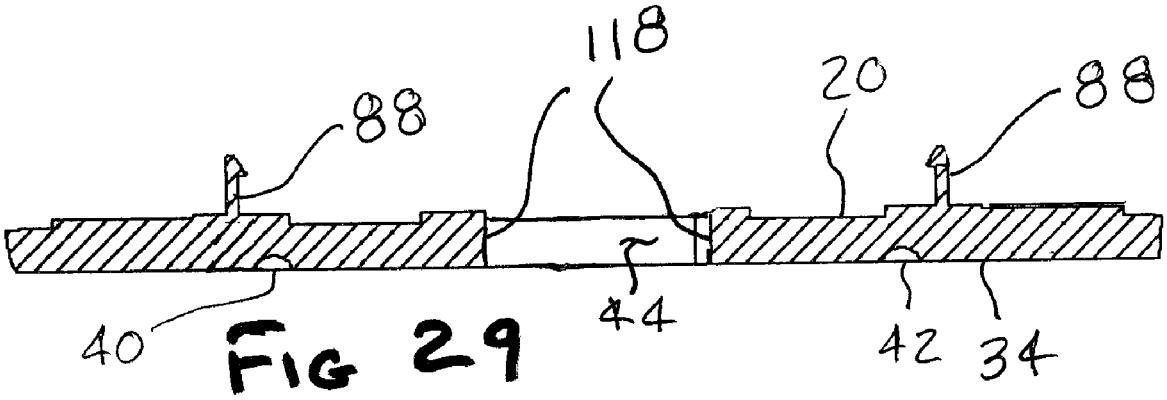
FIG. 29 is a section view taken along line XXIX-XXIX of FIG. 24.
Figure 30:
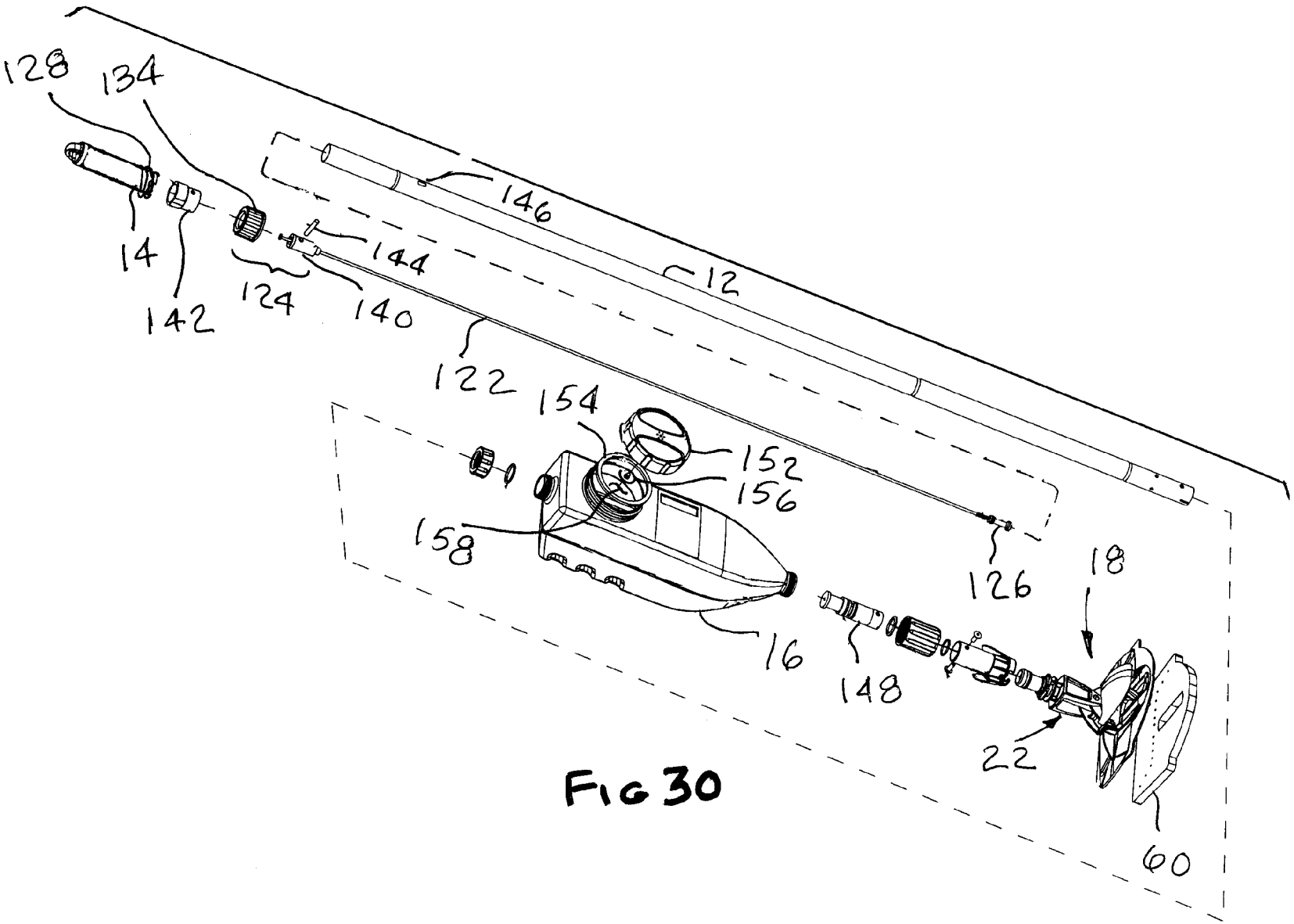
FIG. 30 is an exploded view of the parts of the assembly shown in FIG. 1.
Figure 31:
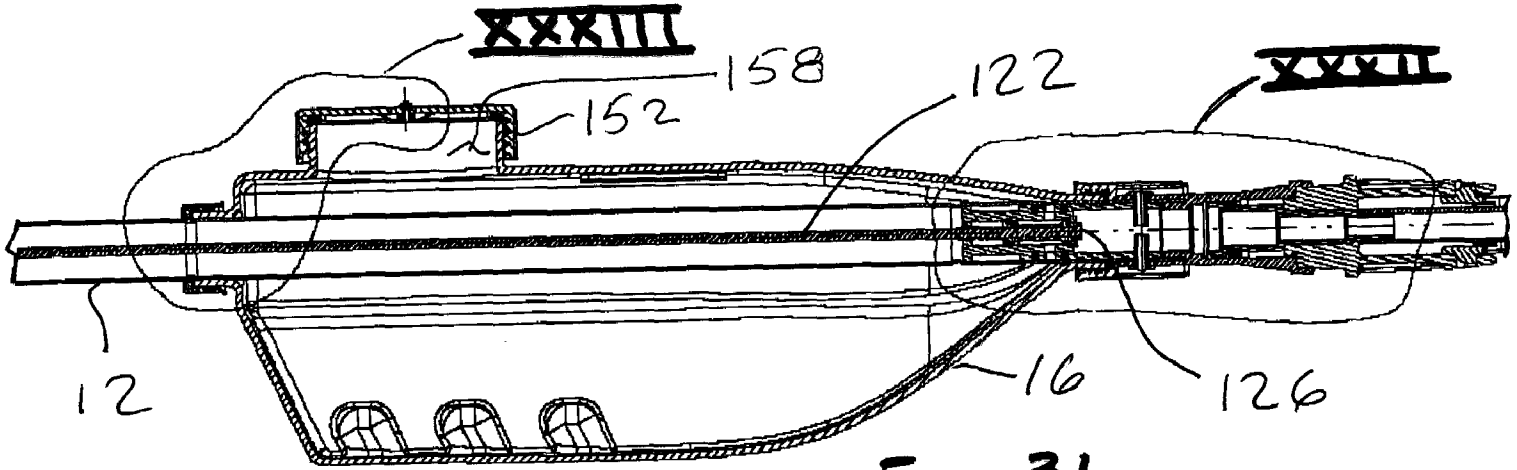
FIG. 31 is an enlarged, fragmentary section view of the assembly shown in FIG. 1 with parts in a first position.
Figure 32:
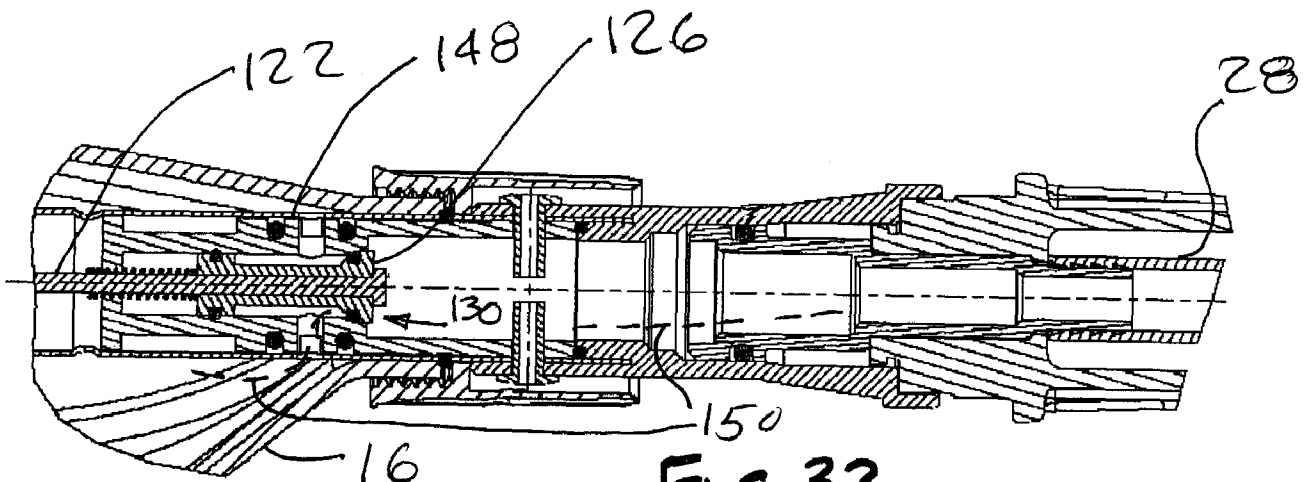
FIG. 32 is a still further enlarged fragmentary section view of detail XXXII from FIG. 31, with parts shown in the first position.

Each bristle assembly 52 is secured in a generally dome-shaped cover 84, which may be seen in FIGS. 17-23. Cover 84 is secured to baseplate 20 at one end of cover 84 by interengagement of a pair of toothed recesses 86 which mate with corresponding toothed rails 88 (see also FIG. 29) on the baseplate 20. Referring now also to FIGS. 5, 7 and 8, a stepped lip 90 on the other end of cover 84 is received through a stepped aperture 92 in baseplate 20 to prevent recesses 86 from unintentionally sliding off toothed rails 88.

Cover 84 also has a pair of transverse bulkheads 94 and 96 to support the pair of first and second groups of bristles 46' and 46" at their respective ferrule ends and cover 84 preferably includes a pair of wedge shaped ribs 98 each having a surface 100 at an angle 102 of about 22.5 degrees to position the respective bristle assemblies 52 in cover 84. Assemblies 52 are preferably secured to cover 84 by a conventional adhesive, such as epoxy, or other conventional fastening, if desired. Bulkheads 94 and 96 are each stepped and preferably extend between a pair of longitudinal stringers 104, 106 with bulkheads 94, 96, ribs 98 and stringers 104, 106 all preferably formed integrally with the remainder of cover 84. Cover 84 and baseplate 20 are preferably formed of molded an ABS polymer material.

Referring now most particularly to FIGS. 10-13, details of the pad 60 may be seen. Pad 60 has a planar working surface 68 and is formed of a laminate 107 of an adhesive layer 108, a closed cell foam layer 110, and a fabric backed bristle or napped layer 112. The laminate 107 has a plurality of relatively small perforations or apertures 114 through all three layers and a relatively large aperture 116 through all three layers. The apertures 114 provide a fluid passageway from the channel 36 and extensions 38 through pad 60 for delivery of stain or other coating fluid to the working surface 68 for application to a generally planar surface to be worked upon. The aperture 116 provides clearance for bristle groups 46' and 46" and allows delivery of the stain or other coating fluid to the bristle groups 46' and 46" via the bristle fluid delivery channels 40 and 42, respectively. It is to be understood that channels 40 and 42 end at respective side edges 118 of recess 44 in the baseplate 20 and the respective side edges 120 of the perimeter of the aperture 116. In a preferred embodiment, the respective side edges 118 are aligned with the respective side edges 120, although such alignment is not necessary in the practice of the present invention, provided that fluid is permitted to be delivered from channels 40 and 42 to the respective bristle groups 46' and 46." Aperture 116 may have a length 117 of about 2.375 inches and a width 119 of about 0.75 inches.

As may be seen most clearly in FIG. 5, fluid exiting channel 42 will descend by gravity to the bristles in group 46" (when the applicator 10 is at least generally upright with the applicator head assembly generally horizontal, as shown in FIGS. 1 and 5). Thereafter the fluid is available for application by bristles in group 46" particularly to a surface perpendicular to face 34. The operation of channel 40 with bristle group 46' is the same.

Figure 14:
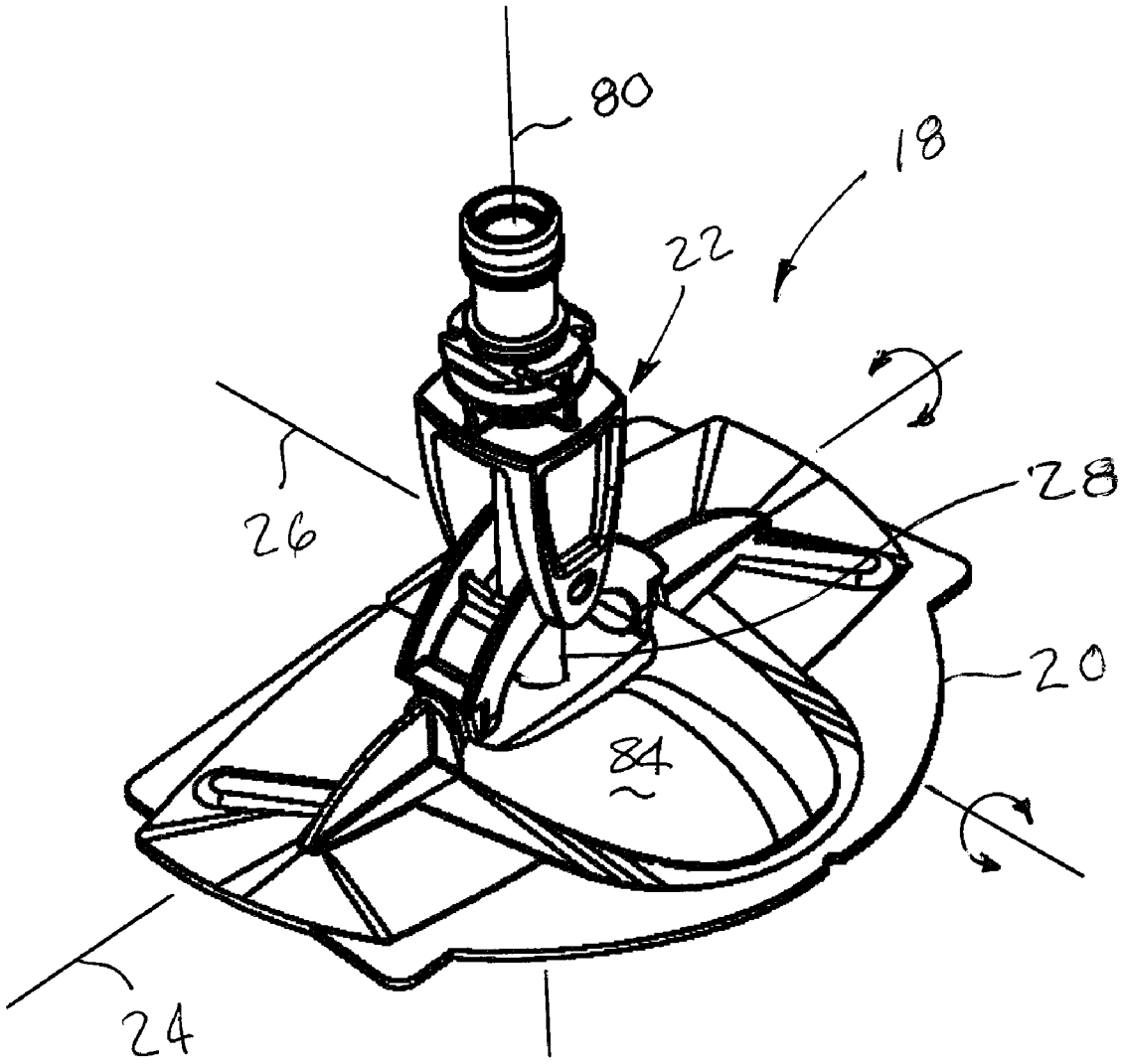
FIG. 14 is a perspective view from above of the applicator head assembly of FIG. 2.
Figure 15:
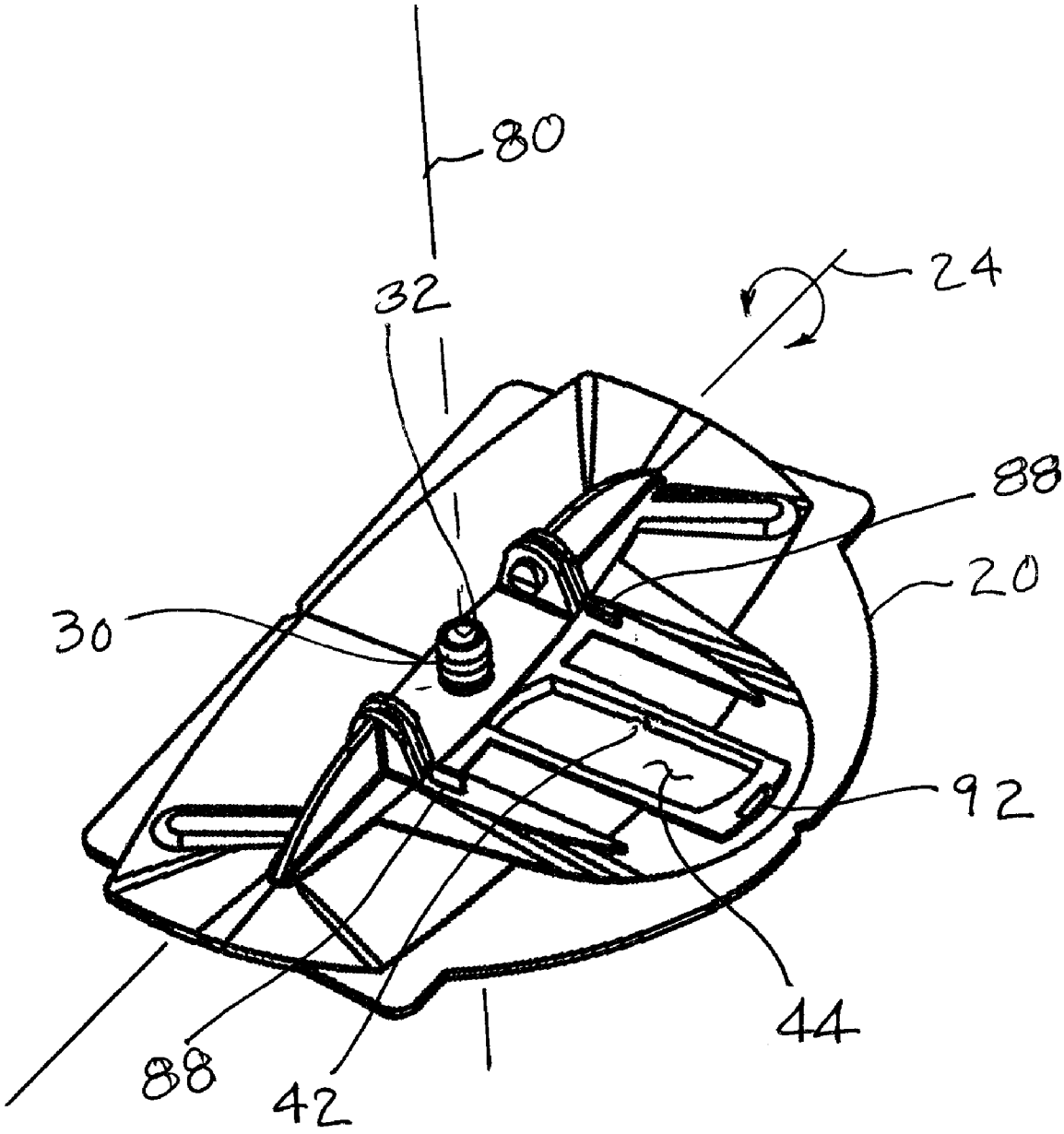
FIG. 15 is a perspective view from above of the baseplate for the applicator head assembly.
Figure 26:
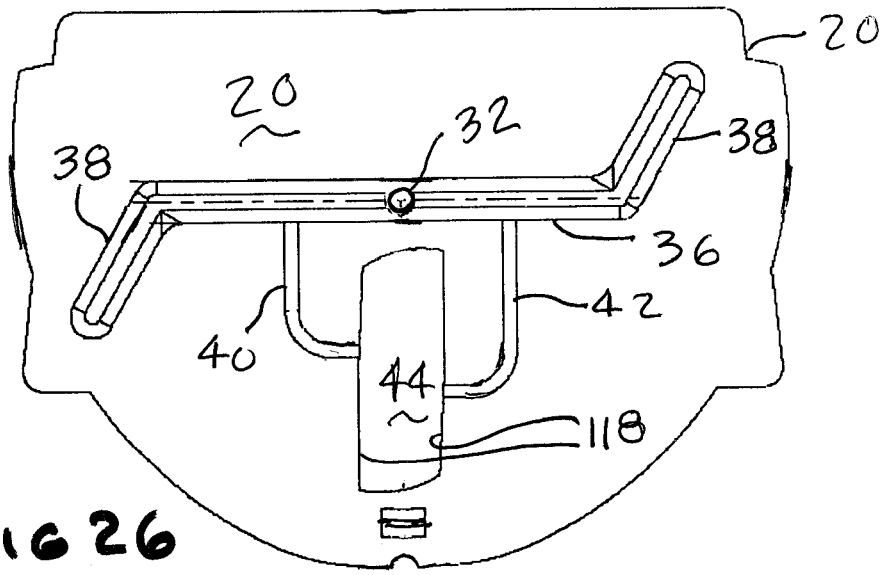
FIG. 26 is a bottom plan view of the baseplate of FIG. 15.
Figure 27:
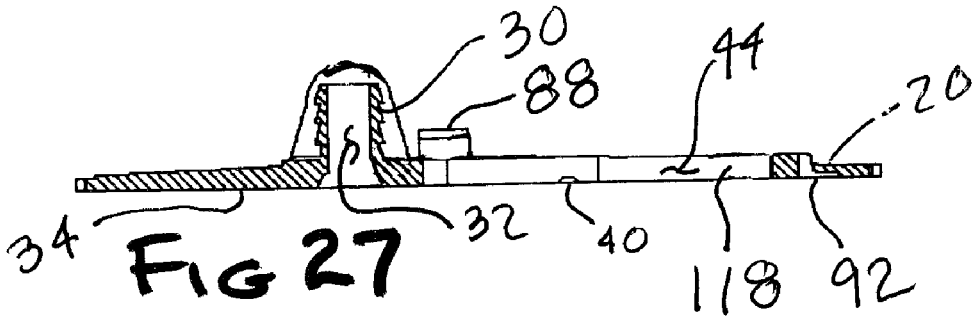
FIG. 27 is a section view taken along line XXVII-XXVII of FIG. 24.
Figure 28:
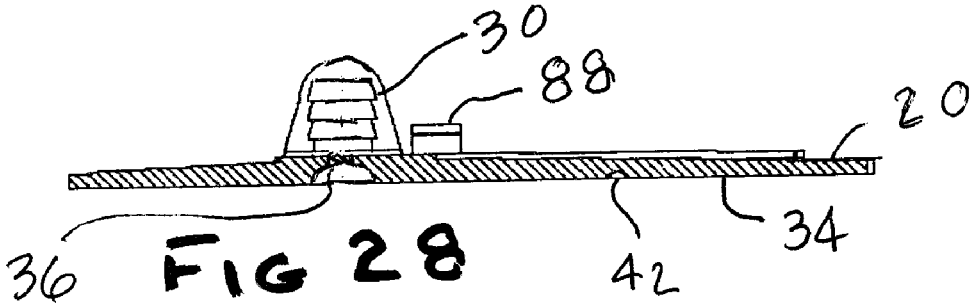
FIG. 28 is a section view taken along line XXVIII-XXVIII of FIG. 24.

FIG. 14 shows a perspective view of the cover 84 and swivel connection 22 together with the baseplate 20. FIG. 15 shows a similar view of the baseplate 20 alone. FIGS. 24-29 show various views of the baseplate 20 to illustrate more clearly certain details thereof. In FIG. 26, aperture 44 may be seen to be generally trapezoidal in shape, to accommodate the bristles in a flexed condition, if desired. Alternatively, aperture 44 may be generally rectangular, and may be similar or congruent to aperture 116 in pad 60, if desired. Either or both of apertures 44 and 116 may have bowed sides (as shown) or straight sides, as desired, while still remaining within the scope of the present invention.

Referring now to FIGS. 30-38, various details of the fluid storage and delivery aspects of the deck stain applicator 10 may be seen. Applicator 10 has a control rod 122 connected between a fluid control assembly 124 and a fluid delivery valve 126. Assembly 124 may be used to open and close valve 126 in a manner described infra. Grip 14 is preferably secured to handle 12 via a bushing 128, which also serves as a threaded reference base for assembly 124. It is to be understood that valve 126 may be moved between a closed position 130 shown in FIG. 32 and an open position 132 shown in FIG. 38 by rotating a ring 134 threadably received on threads 128. Rotating ring 134 will axially move rod 122, to advance or retract valve member 126. A pair of sleeves 140, 142 are secured together via a cross pin 144 extending through an elongated aperture 146 in handle 12. Outer sleeve 142 moves axially with ring 134, as ring 134 is rotated on the threads of bushing 128. Pin 144 transmits the motion of outer sleeve 142 to inner sleeve 140 and rod 122, while the engagement of pin 144 in aperture 146 prevents rotation of sleeve 140 and rod 122. Movable valve member 126 moves axially within a valve housing 148 to open and close a fluid path 150 from reservoir 16 to the applicator head assembly 18.

Figure 33:
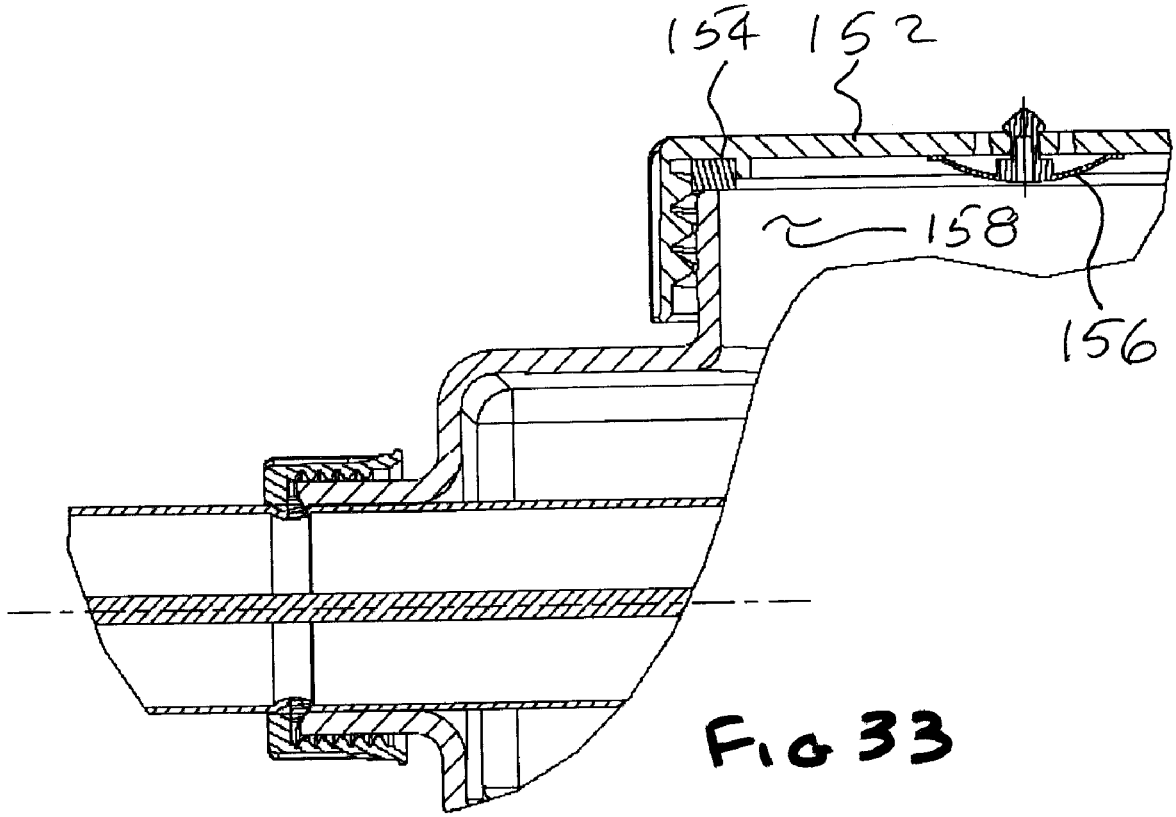
FIG. 33 is a view of detail XXXIII from FIG. 31.
Figure 34:
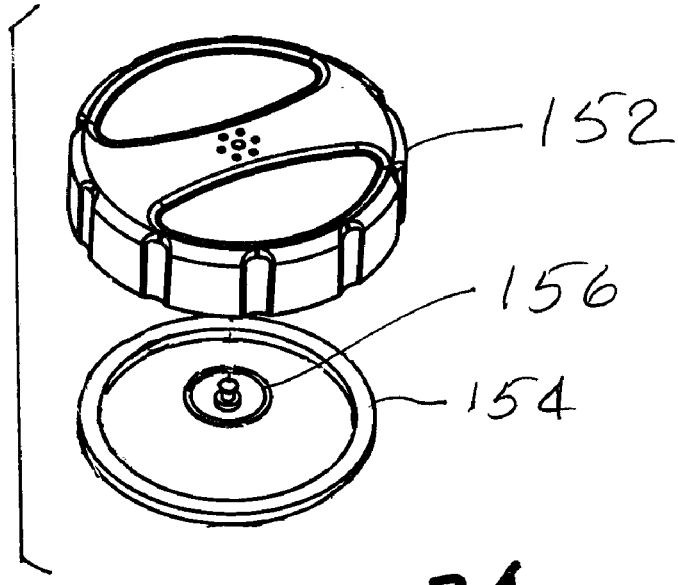
FIG. 34 is an enlarged, exploded perspective view of a cap, washer and valve from FIG. 33.
Figure 35:
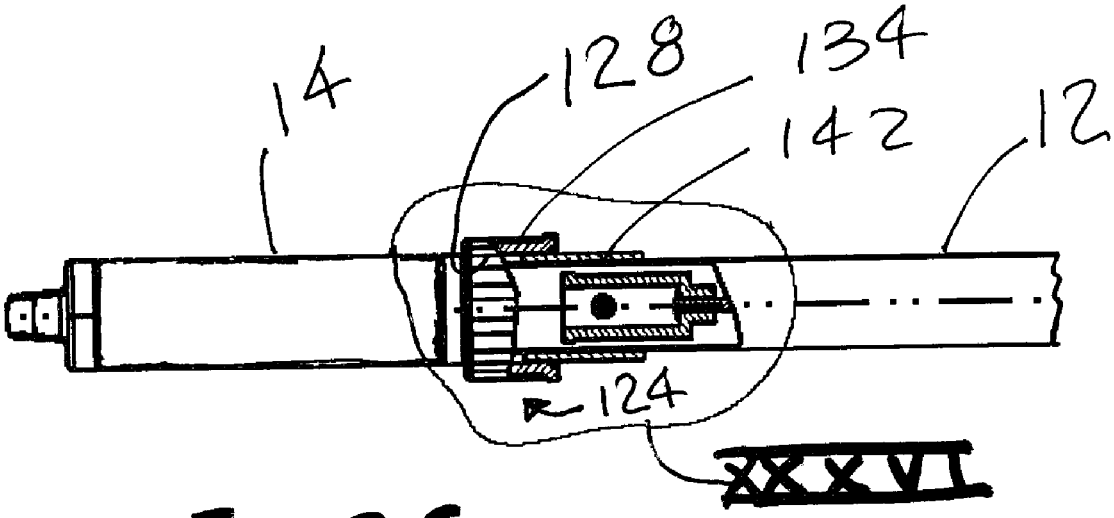
FIG. 35 is a view of a handle end of the assembly of FIG. 1, with some parts cut away.
Figure 36:
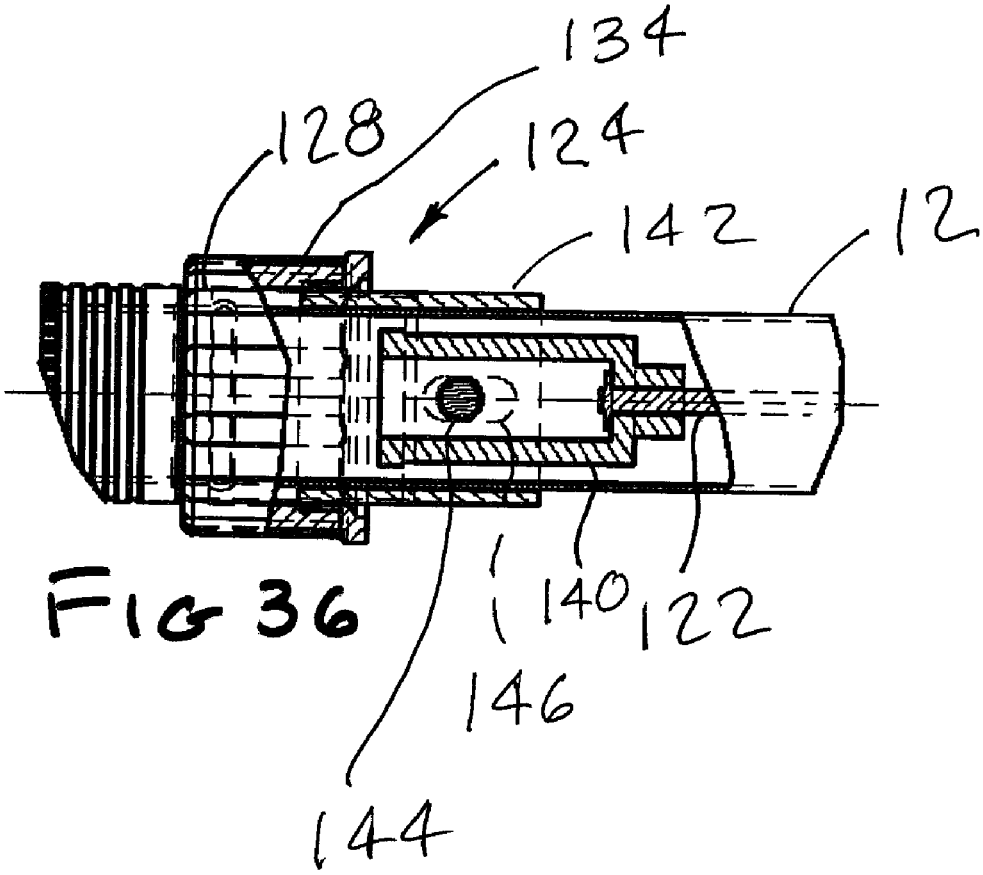
FIG. 36 is a view of detail XXXVI from FIG. 35.
Figure 37:
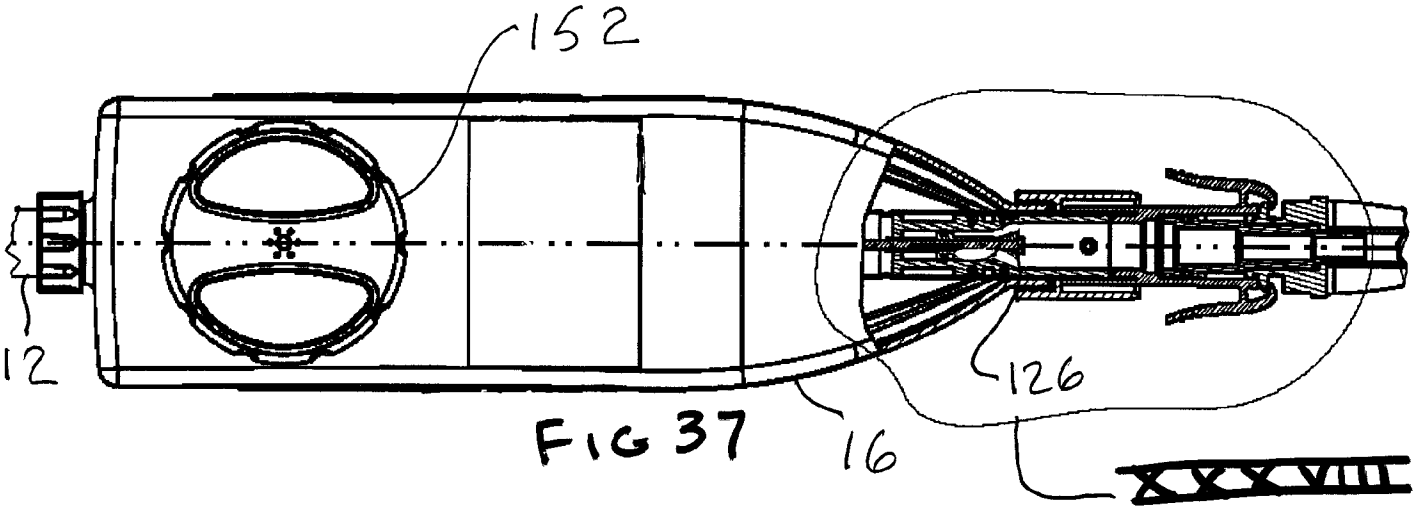
FIG. 37 is a view similar to that of FIG. 31, except with the assembly rotated 90 degrees and with parts in a second position.
Figure 38:
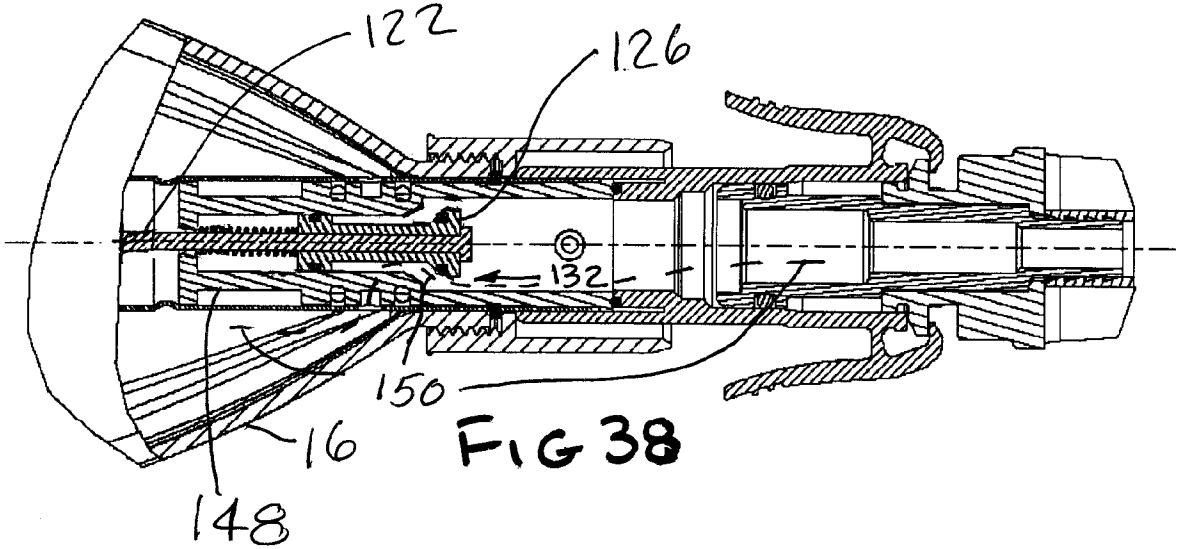
FIG. 38 is a view of detail XXXVIII from FIG. 37 with parts shown in the second position.

Referring now to FIGS. 33 and 34, a threaded cap 152 has a vacuum relief valve 156 and a gasket 154. Coating material may be added to reservoir 16 by removing cap 152 and filling reservoir 16 via a fill opening 158. When valve 126 is opened and the applicator is positioned to allow liquid in reservoir 16 to flow along path 150, valve 156 prevents a vacuum that might otherwise develop in the interior of reservoir 16 from preventing or deterring the liquid coating material from exiting the reservoir 16.

To use the applicator 10, a suitable liquid coating material is placed in reservoir 16, and the cap 152 is secured to opening 158 to retain the liquid in the reservoir. Fluid delivery valve 126 is moved to the open position 132 by rotating ring 134. The applicator head assembly is then placed against a surface to be coated, typically formed of generally planar, horizontally extending members such as boards, with gaps between the members or boards having opposed surfaces perpendicular to the plane of the main surface being treated, e.g., applying stain to a deck. The bristle groups 46 will receive the stain or other liquid coating material and apply it to the opposed surfaces in the gap, it being understood that the opposed surfaces are typically oriented vertically. When the applicator head assembly is moved across the gapped horizontal planar surface such that the bristle groups 46 are no longer aligned with a gap, the bristles 48 will flex and be received in the aperture 116 and recess 44, so that the working surface 68 may remain in contact with the main horizontal surface being treated. Once at least some of the bristles 48 are aligned with a gap, the bristles 48 will straighten out generally to the position shown in FIGS. 2 and 4, for coating the opposed surfaces forming the gap into which the bristles then extend.

The invention is not to be taken as limited to all of the details thereof as modifications and variations thereof may be made without departing from the spirit or scope of the invention.

The invention claimed is:

1. A method of applying coating material to a generally planar deck or deck-like surface of the type having members having opposed surfaces separated by gaps, the method comprising the steps of:

a) applying the coating material to the generally planar surface by delivering the coating material to a generally flat coating applicator pad through at least one delivery channel adjacent the applicator pad; and b) simultaneously applying the coating material to opposed surfaces of the members in the gap by delivering the coating material to the opposed surfaces using a plurality of bristles extending out of the planar surface.

2. The method of claim 1 wherein the bristles are flexible.

3. The method of claim 1 wherein the pad includes at least one recess adjacent the plurality of bristles and wherein the method further comprises the additional step of:

c. moving the plurality of bristles into the recess by moving the pad across a planar surface to a condition wherein the plurality of bristles are not aligned with the gap.

4. The method of claim 1 further including an additional step before step b) of a1) delivering the coating material to the plurality of bristles through at least one bristle fluid delivery channel adjacent the applicator pad.

5. The method of claim 4 wherein step a1) further comprises delivering the coating material from the bristle fluid delivery channel to the plurality of bristles via gravity.

* * * * *